United States Patent [19]

Robinson

[11] 4,330,939

[45] May 25, 1982

[54] TEMPLATE FOR TRIMMING COVED LINOLEUM AND THE LIKE

[76] Inventor: John E. Robinson, 161 San Federico Ave., Santa Barbara, Calif. 93111

[21] Appl. No.: 132,134

[22] Filed: Mar. 20, 1980

[51] Int. Cl.[3] ..... B26B 29/00

[52] U.S. Cl. ..... 30/289; 30/294

[58] Field of Search ..... 30/289, 294

[56] References Cited

U.S. PATENT DOCUMENTS 1,140,233 5/1915 Anderson ..... 30/294

3,509,633 5/1970 Fernandes ..... 30/289

*Primary Examiner*—Stephen G. Kunin

*Assistant Examiner*—J. T. Zatarga

*Attorney, Agent, or Firm*—Daniel J. Meaney, Jr.

[57] ABSTRACT

A template for trimming coved linoleum positioned against a wall at a corner to form a symmetrical coved linoleum corner between two linoleum edges wherein the template includes an elongated guide support for clamping a linoleum end, which extends beyond a wall corner, against a wall and the elongated guide support terminates in an end which defines one side of a longitudinal cutting-tool receiving slot at the wall corner, a base plate which is adapted to be placed against the linoleum end which extends beyond the wall corner wherein the base plate terminates in an end which defines the other side of a longitudinal cutting-tool receiving slot and wherein the base plate is joined to the elongated guide support by a fastening means to form an assembly having a cutting-tool receiving slot wherein the slot has a predetermined width and angle relative to the corner and an elongated guide member having a selected length which is secured at one end to the bottom portion of the elongated guide support on the end opposite to that defining one side of the cutting-tool receiving slot and wherein the other end of the elongated guide member terminates in a guide element which engages a wall corner to position the elongated guide support and base plate assembly relative to the wall corner such that the cutting-tool receiving slot is located at the wall corner and a cutting-tool can be inserted into the slot, projected through the linoleum end and drawn along the slot to sever the linoleum end to form a linoleum edge having a preselected angle such that the angular cut linoleum edge is adapted to mate with an abutting linoleum edge having a similar preselected angular cut to form a symmetrical coved linoleum corner between the two abutting linoleum edges is shown.

6 Claims, 8 Drawing Figures

TEMPLATE FOR TRIMMING COVED LINOLEUM AND THE LIKE

BACKGROUND OF THE INVENTION

1. Field of the Invention

This invention relates to a template adapted for use with floor covering to form a symmetrical corner between two adjacent edges which define a coved floor covering and more particularly to a template adapted for use for forming a symmetrical corner in coved linoleum wherein the template is adapted to be used with a cutting-tool inserted through a cutting-tool receiving slot in the template for severing ends of coved linoleum ends to form a linoleum edge having a preselected angle which mates with a corresponding linoleum edge having a similar preselected angle to form a symmetrical corner for the coved linoleum ends defining a corner.

2. Description of the Prior Art

It is known in the prior art to use trimming templates for carpeting, linoleum, and the like. Typical of such devices are carpet trimming templates disclosed in U.S. Pat. Nos. 3,678,586, 4,057,898 and 3,772,793. In the templates disclosed in the prior art, a cutting-tool is inserted into a cutting-tool receiving slot, and the floor covering is severed. If the floor covering to be trimmed in a flat edge, the tool receiving slot is usually an elongated slot. However, if the carpeting to be severed is other than an edge, such as a circle, the template normally provides a pattern for severing the floor covering.

In the installation of floor coverings in the form of linoleum or the like, it is known in the art to utilize a scribing device to mark the linoleum with a scribe line. A cutting-tool is then used to hand cut the linoleum along the scribe line. Typical of the scribing devices are those disclosed in U.S. Pat. Nos. 2,287,601, 2,296,232, 2,176,733, 3,127,681 and 2,654,953.

Certain of the known prior art devices include means for cutting the linoleum or floor covering concurrently with the trimming tool being moved relative to an edge. Typical tools which include cutting blades as part thereof are disclosed in U.S. Pat. Nos. 3,276,119 and 2,383,368.

It is also known in the prior art to use a cutting guide or template for a number of other applications, such as cutting cakes, as described in U.S. Pat. No. 3,987,541; cutting pies, as described in U.S. Pat. No. 2,560,271; and sandwiches, as shown in U.S. Pat. No. 2,057,250.

None of the devices of the prior art relate to a template adapted for use in trimming the end of floor coverings or linoleums which are mounted in a coved arrangement.

Typically, a person installing the linoleum utilizes a scribing tool, such as disclosed in U.S. Pat. No. 2,287,601, to scribe the linoleum end. The scribed abutting end is then hand cut with the linoleum knife of other cutting-tool to form the symmetrical corner in the coved linoleum.

SUMMARY OF THE INVENTION

This invention relates to a new, novel and unique template for trimming coved linoleum positioned against a wall at a corner to form a symmetrical coved linoleum corner between two linoleum edges. In the preferred embodiment, the template includes an elongated guide support which is adapted to be placed against the surface of a coved piece of linoleum having ends which extend beyond the corner which is to have the coved linoleum formed thereon. The elongated guide support is urged against the linoleum end to hold the same securely against the wall. One end of the elongated guide support terminates in a longitudinal reversed edge which is located adjacent the wall corner. The longitudinal reversed edge extends along the width of the linoleum end to be trimmed, and the edge has an angle in the direction of deflection which is outward from the wall corner. The plane on the bottom edge of the longitudinal reversed edge is positioned to intersect with the wall corner. The longitudinal reversed edge of the elongated guide support defines one side of a longitudinal cutting-tool receiving slot which is located by the wall corner. A base plate is adapted to be positioned against the abutting linoleum end extending beyond the wall corner. The base plate terminates in a longitudinal deflected edge which is adapted to be located against the wall corner. The longitudinal deflected edge extends along the width of the linoleum end to be trimmed, and the angle and direction of the deflected edge are in an opposed spaced relationship to the longitudinal reversed edge on the elongated guide support. The longitudinal deflected edge on the base plate is joined to the longitudinal reversed edge on the elongated guide support to form an assembly having a predetermined spaced slot which defines a longitudinal cutting-tool receiving slot.

An elongated guide member having a selected length, and which terminates in a guide element in one end, is secured at the other end thereof to the bottom of the elongated guide support. The elongated guide member is fixedly movable relative to the elongated guide support, such that the guide element engages the wall which defines one wall corner and which intersects with the coved linoleum end which is to be trimmed. The guide element contacts the wall, and the elongated guide support and base plate assembly are adjusted relative to the guide element such that the cutting-tool receiving slot essentially intersects with the wall corner. The linoleum end extends beyond the wall corner and the slot and is located between the elongated guide support elongated guide member. A cutting-tool can be inserted into the slot projecting through the linoleum end and drawn along the slot to sever the linoleum end. The linoleum end then has an edge which has a preselected angle therein, and the abutting edge having the preselected angle is adapted to mate with an adjacent linoleum edge having a similar preselected angle such that the two linoleum edges form a symmetrical coved linoleum corner between the linoleum edges.

By use of the device of the present invention, one overcomes several inherent problems of the prior art devices. In the template used for carpeting and floor coverings, the carpeting edge which is severed or trimmed is cut along an edge which is adapted to be planar relative to a floor and normal to the wall.

In coved floor covering applications, the floor covering traverses a 90° angle and terminates against the wall. When the coved floor covering is to be cut at a wall corner, it is necessary to cut an abutting edge which has a preselected angle such that a symmetrical corner is formed. Thus, the coved corner not only has a 90° angle, but must also be cut to have smooth symmetrical coved corner edges which, when abutted together, do not disrupt or otherwise distort the coved structural relationship of the floor covering against the wall and at the corner. The prior art devices do not provide a template for cutting the edges of floor covering to make a symmetrical corner.

The use of scribing devices, as is known in the prior art, requires that linoleum ends be hand cut to form the required linoleum or floor covering edges.

The present invention overcomes the inherent disadvantages of the prior art devices by use of a unique and novel template which enables a user to insert a cutting-tool into a cutting-tool receiving slot which functions both as a guide and support such that a positive, uniform angular abutting edge is cut and formed in the floor covering. This avoids distortions or other imperfections which occur in a floor covering edge which is cut by an unguided cutting-tool.

Accordingly, one advantage of the present invention is that the template can be utilized to form a symmetrical corner in coved floor covering ends which have been cut at a predetermined angle such that, when the cut floor covering ends are positioned in an abutting relationship to define a corner, a smooth symmetrical corner is formed.

Another advantage of the present invention is that a conventional cutting-tool can be utilized to form a smooth, even, uniform severing of the ends of the floor covering to form a smooth symmetrical corner.

A still further advantage of the present invention is that the elongated guide support and the base plate are joined to form an assembly having a cutting-tool receiving slot which is adapted to be positioned at a predetermined angle relative to the corner to form a 45° symmetrical cut in the floor covering end. Each mating floor covering end is cut at approximately a 45° angle, resulting in a smooth symmetrical corner.

Another further advantage of the present invention is that the elongated guide support and base plate assembly and elongated guide member cooperate such that, when the template is positioned against a corner which is to have linoleum ends trim to fit symmetrically therearound, the elongated guide member spaces the cutting-tool receiving slot at precisely the same predetermined angle relative to a wall corner for cutting two abutting linoleum ends to insure that both abutting edges of each linoleum end are cut at precisely the same angle, so that a smooth symmetrical corner is obtained in the coved linoleum at the wall corner.

Yet a still further advantage of the present invention is that a base plate extension member can be removably attached to the base plate such that, when a corner is a sufficient distance from an adjacent wall, the coved floor carpeting end to be severed can be urged against the wall by the elongated guide support, base plate and base plate extension to positively hold the entire floor carpeting end in position such that the end thereof can be precisely cut at a predetermined angle by a cutting-tool placed into the cutting-tool receiving slot.

A still further advantage of the present invention is that, if the coved linoleum or floor covering end is positioned in a tight or short corner, the base plate extension can be removed, and the tight or small corner can still be formed by cutting the floor covering or linoleum ends at a predetermined angle to form a symmetrical uniform corner around the wall.

BRIEF DESCRIPTION OF THE DRAWING

These and other objects of the invention, together with its various features and advantages, can be more easily understood from the following more detailed description of the preferred embodiment taken in conjunction with the accompanying drawing in which.

DESCRIPTION OF THE PREFERRED EMBODIMENT

Figure 1:
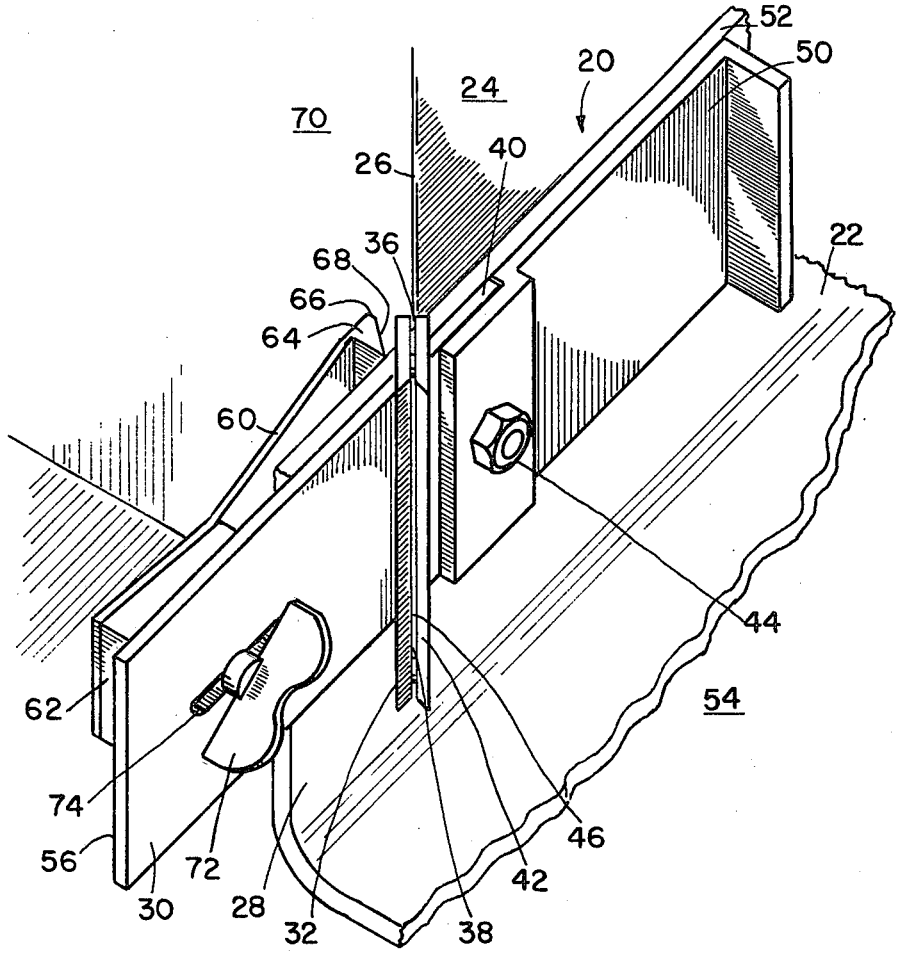
FIG. 1 is a perspective view showing the template for trimming coved linoleum positioned against a wall at a corner to form a symmetrical coved linoleum corner between two linoleum edges.

The template illustrated in FIG. 1 is generally illustrated as 20. The template is adapted to be used for trimming a coved linoleum generally illustrated as 22, which is positioned against a wall 24 at a corner 26. The template is adapted to be used to trim the coved linoleum 22 to form a symmetrical coved linoleum corner between two linoleum ends, one of which is illustrated as end 28.

In the illustration of FIG. 1, one linoleum end 28 is illustrated and the linoleum installer would generally work with each linoleum end 28 independently in forming the symmetrical coved linoleum corner.

The template 20 includes an elongated guide support 30 which is adapted to be placed against the surface of a coved piece of linoleum 22 having an abutting end 28. The elongated guide support 30 is adapted to urge the linoleum end 28 against wall 24 enabling the linoleum end 28 to extend beyond the wall corner 26. The elongated guide support 30 terminates in a longitudinal reversed edge 32 which is adapted to be located adjacent the wall corner 26.

The longitudinal reversed edge 32 extends along the width of the elongated guide support 30 which is located adjacent to the linoleum end 28 which is to be trimmed into a symmetrical coved linoleum corner. The longitudinal reversed edge 32 is deflected at an angle and direction which is outward from the wall corner 26. The plane of the bottom edge 36 of the longitudinal reversed edge 32 is adapted to intersect with the wall 24 adjacent the wall corner 26.

The longitudinal reversed edge 32 defines one side of a longitudinal cutting-tool receiving slot 38 which is positioned at a predetermined angle relative to the wall corner 26.

A base plate 40 is adapted to be placed against the abutting linoleum end 28 extending beyond the wall corner 26. The elongated guide support 30 terminates in a longitudinal deflected edge 42 which is adapted to be located adjacent the wall corner 26. The longitudinal deflected edge 42 extends along the width of the linoleum end 28 which is to be trimmed. The angle and direction of the longitudinal deflected edge 42 is in an opposed spaced parallel relationship to the longitudinal reversed edge 32 on the elongated guide support 30. The longitudinal deflected edge 42 is joined to the longitudinal reversed edge 32 to form an assembly having a predetermined spaced slot 38 therebetween wherein the bottom portion 46 of the longitudinal deflected edge 42 defines the other side of a longitudinal cutting-tool slot 38.

In the preferred embodiment, a base plate extension 50 is adapted to be fastened to the end of base plate 40 adjacent the end terminating in the longitudinal deflected edge 42. The base plate extension 50 is adapted to engage and urge the linoleum end 28 against the wall 24 to form a tight clamping surface between the elongated guide support 30, the base plate 40, the base plate extension 50 and the surface of the linoleum end 28.

The linoleum 22 is formed into a coved arrangement whereby the linoleum 22 extends from its parallel relationship with the floor 54 and is curved from the floor toward the wall 24 through a 90° angle and terminates in an edge 52 which is parallel to and urged against the wall 24. In a normal installation, a strip holder or linoleum finishing strip is utilized to esthetically finish the coved floor covering or coved linoleum installation.

The template 20 includes an elongated guide member 60 which has a selected length and which is secured at one end thereof at a slideable block 62. Block 62 is secured to the bottom portion 56 of the elongated guide support 30 on the end opposite to that terminating in said longitudinal reversed edge 32. The elongated guide member 60 terminates at its other end in a guide element 64. The guide element 64 having an engagement surface 66 is adapted to engage a wall corner on wall 70 which is normal to the wall 24. The guide element 64 engages the wall 70 at engagement surface 66.

The elongated guide member 60 is secured to the elongated guide support 30 in a manner to enable the guide element 64 to engage the wall 70. Wall 70 is the wall which defines the other side of a wall corner 26 and intersects with the linoleum end 28. The guide element 64 essentially positions the elongated guide support 30 and base plate 40 assembly relative to the wall 70 such that the cutting-tool receiving slot 38 is positioned opposite the wall corner 26 with the linoleum end 28 to be severed extending past the slot 38. As shown by end 52 of linoleum end 28, the linoleum end extends between the bottom portion 64 of the elongated guide support 30 and the elongated guide member 60. In use, a cutting-tool can be inserted into the slot 38 and projected through the linoleum end 28 and drawn along the slot 38. The cutting-tool, when drawn along the slot 38, severs the linoleum end 28 to form a linoleum edge having a preselected angle. A mating linoleum edge having a preselected angle is formed in a linoleum end which is similarly cut to have a preselected angle formed in a second linoleum end (not shown) which would be positioned adjacent wall 70. The two mating angled, linoleum edges form a symmetrical coved linoleum corner between the two linoleum edges having preselected angles.

In the preferred embodiment, illustrated in FIG. 1, a fastening means, in the form of a thumbscrew 72, is provided for removably affixing the block 62 and elongated guide member 60 to the bottom portion of the elongated guide support 30. A slot 74 in the elongated guide support 30 is provided for the thumbscrew 72 to be attached to and move with block 62. The fastening means 72 is adapted to permit relative movement between the block 62 having the elongated guide member 60 affixed thereto, and the elongated guide support 30 to position the guide element 64 against the wall 70 adjacent wall corner 26. The elongated guide support 30 and base plate 40 assembly is moved relative to the guide member 64 to precisely position the cutting-tool receiving slot 38 relative to the wall corner 26 to obtain the desired angular cut in the linoleum end 28.

In the preferred embodiment, the cutting-tool slot 38 is positioned at an approximately 45° angle, as measured from the plane of the linoleum end which extends beyond the wall corner 26.

Figure 2:
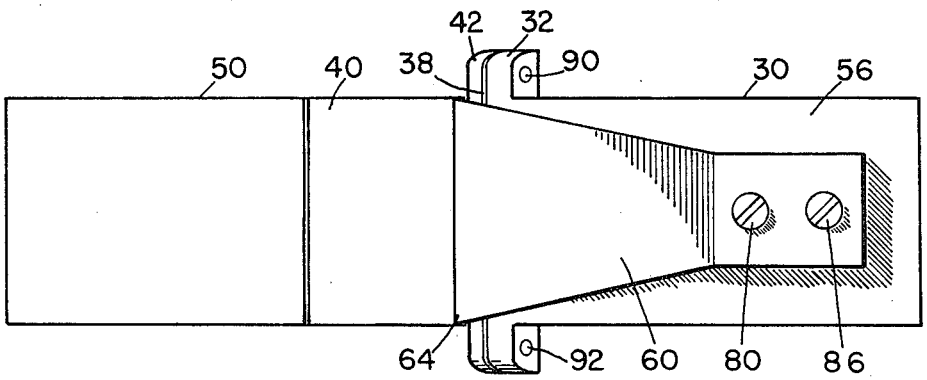
FIG. 2 is a back plan view showing the elongated guide support, the base plate and elongated guide member.

In FIG. 2, the arrangement and position of the elongated guide support 30, the elongated reversed edge 32, the base plate 40, the longitudinal deflected edge 42 and the base plate extension 50 are illustrated in greater detail. The elongated guide member 60 is attached to the block 62 (shown in FIG. 1) by means of fastening means such as screws 80 and 86. The block 62 is attached to thumbscrew 72 and is adapted to be moved relative to the elongated guide support 30 in slot 74 as illustrated in FIG. 1.

In order to adjust the elongated guide member 60 relative to the longitudinal extending tool receiving slot 38, the thumbscrew 72 is loosened, and the block 62 is adjusted by sliding the thumbscrew 72 within slot 74 until the cutting-tool receiving slot 38 is positioned properly relative to the corner 26.

Referring again to FIG. 2, the elongated guide member 60 terminates in the guide element 64. In the preferred embodiment, the elongated guide member 60 is formed of a resilient elongated member having a bias which urges a gripping member 68, which is formed in the guide member 64 as shown in FIG. 1, toward the bottom 56 of the elongated guide support 30.

In the preferred embodiment, the edge 52 of linoleum end 28, when positioned between the elongated guide element 60 and the bottom surface 56 of the elongated guide support 30, results in the gripping member 68 removably holding the linoleum edge 52 tightly against the bottom 56 of the elongated guide support 30 to facilitate cutting and severing of the linoleum end 28 to form the linoleum edge having a preselected angle therein.

In FIG. 2, the longitudinal reversed edge 32 and the longitudinal deflected edge 42 are joined together by a fastening means 90 and 92 which are adapted to removably join the edges 32 and 42 to define the dimensions of the slot 38.

Figure 3:
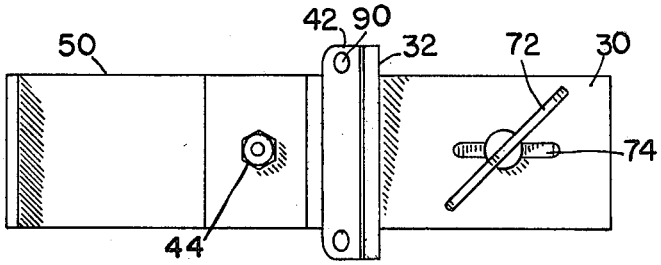
FIG. 3 is a front plan view of the template showing the elongated guide support, the base plate, base plate extension and the cutting-tool receiving slot formed by the ends of the elongated guide support and base plate.

FIGS. 3 through 6 show the various elements in greater detail and the relationship therebetween. Specifically, FIG. 3 shows the elongated guide support 30, the adjusting thumbscrew 72 in slot 74, the longitudinal reversed edge 32, the base plate 40, the longitudinal deflected edge 42 and the base plate extension 50 which is joined to the base plate 40 by the nut and bolt assembly 44. Fasteners 90 and 92 join the elongated guide support 30 and base plate 40 into an assembly.

Figure 4:
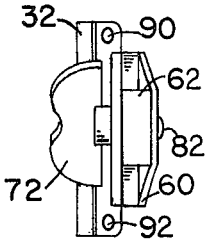
FIG. 4 is a right end plan view of the template of FIG. 3.

FIG. 4 shows the block 62 and its relationship to the thumbscrew 72, the elongated guide member 60, the fastening means 82, the longitudinal reversed edge 32, and the fastening means 90 and 92.

Figure 5:
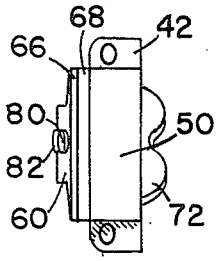
FIG. 5 is a left end plan view of the template of FIG. 3.

FIG. 5 shows the base plate extension 50, the thumbscrew 72, the longitudinal deflected edge 42, the elongated guide member 60, the guide element 64, the engagement surface 66, the gripping member 68 and fastener 80.

Figure 6:
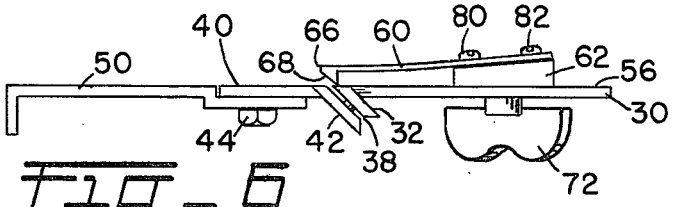
FIG. 6 is a top plan view of the template of FIG. 3, showing in detail the relationship between the cutting-tool receiving slot and a resilient elongated guide member of the preferred embodiment.

FIG. 6 shows the relationship between the elongated guide support 30, the base plate 40, the base plate extension 50 and the elongated guide member 60. Specifically, the elongated guide member 60 is joined by fasteners 80 and 82 to a block 62 which is, in turn, attached to thumbscrew 72. The guide element 66 and the gripping member 68 are movable relative to the slot 74 (FIG. 1) to align the cutting-tool receiving slot in substantial alignment with the wall corner 26. In the preferred embodiment, the angle of slot 38 relative to the bottom of the base support plate 56 is 45°. Thus, when a cutting-tool is inserted into and drawn through the slot to sever the linoleum end, the angle of the edge of the linoleum edge is approximately 45°.

Figure 7:
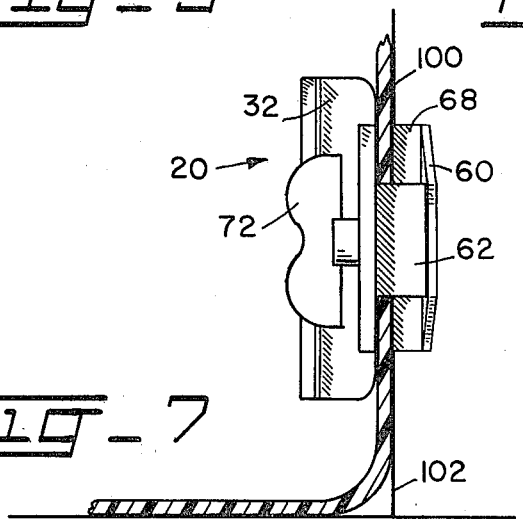
FIG. 7 is a diagrammatic right end plan view showing the template in position to permit insertion of a cutting-tool into the cutting-tool receiving slot.

FIG. 7 shows diagrammatically how the template is installed relative to a coved linoleum end 100. The elongated deflected edge 32 is adapted to receive a cutting-tool, and the guide member 60 which is a resilient member in the preferred embodiment has a bias which urges the gripping member 68 toward and into engagement with the coved linoleum end 100. The template 20 can be moved in a vertical direction relative to wall 102 such that the linoleum end 100 is cut through the entire vertical height thereof.

Figure 8:
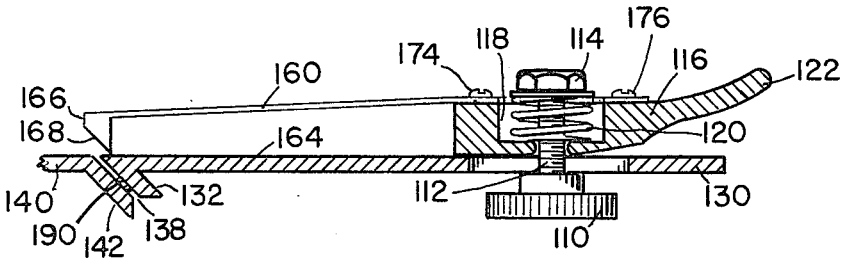
FIG. 8 is another embodiment of a template utilizing the teachings of the present invention wherein a spring is provided to urge the elongated guide member having a gripping member at the end thereof toward the bottom of the elongated guide support.

FIG. 8 shows another embodiment wherein an elongated guide member 160 is affixed to an elongated guide support 130. A thumbscrew 110 having a threaded portion 112 which terminates in a nut 114 is provided. A pivotable support block 116 having a hollowed out central area 118 which is adapted to have the threaded portion 112 of the thumbscrew 110 extend axially therethrough is adapted to have a coaxially aligned spiral spring 120 mounted therein. The spring 120 is urged into compression by tightening of the nut 114 relative to the thumbscrew 110. A pivotable support block 120 is adapted to be deflected by urging a downward force on end 120 which has the effect of lifting a resilient elongated guide member 160 such that guide element 166 and the gripping member 168 are lifted away from the bottom portion 164 of the base support 130. The base support 130 likewise terminates in a reversed deflected edge 132, and a base plate 140 likewise terminates in a deflected end 142. The longitudinal reversed end 132 and longitudinal deflected end 142 are joined by a fastening means shown as 190. In use, the pivotable support block 116 is rotated by a downward pressure urged against extended member 122 which causes the rotation of the block 116 against and around the threaded portion 112 of thumbscrew 110 overriding the force of the resilient spring 120 and enabling the raising of the guide member 166 and gripping member 168 away from the bottom portion 164. The template then can be slipped over an end of linoleum, such as illustrated as linoleum end 100 in FIG. 7, and the pressure released. The resiliency of spring 120 and the resiliency of elongated guide member 160, which has a bias which urges the gripping member 168 into engagement with the linoleum end, holds the linoleum end securely during the severing and cutting of the longitudinal end thereof by cutting-tool into an angled linoleum edge.

The template of the present invention has wide application in the floor covering field. However, it is envisioned that the template has utility for a number of particular applications such as the installation of coved linoleum on floors, curved or coved formica tops on counter tops, and any other installations which require the use of a thin laminar sheet adapted to be formed into a curved or coved surface to cover an angular transition of one wall to a second wall. The cutting-tool adapted to be used in conjunction with the template is a conventional carpet cutting-tool or linoleum cutting-tool, sharp knife, or other similar cutting-tool.

What is claimed is:

1. A template for trimming coved linoleum positioned against a wall at a corner to form a symmetrical coved linoleum corner between two linoleum edges comprising an elongated guide support terminating in a longitudinal reversed end which extends outwardly therefrom at an acute angle in a predetermined direction and wherein the longitudinal reversed end includes a bottom edge which defines one side of a longitudinal cutting-tool receiving slot;

a base plate terminating in a longitudinal deflected edge which extends outwardly therefrom at said acute angle and in said predetermined direction to position said longitudinal deflected edge in opposed spaced parallel relationship to the longitudinal reversed edge of the elongated guide support, said longitudinal deflected edge including a bottom portion and being joined to said longitudinal reversed edge to form an assembly having a predetermined spaced slot therebetween wherein the bottom portion of the longitudinal deflected edge defines the other side of a longitudinal cutting-tool receiving slot;

an elongated guide member having a selected length and secured at one end thereof to the bottom portion of said elongated guide support on the end opposite to that terminating in said longitudinal deflected edge, said elongated guide member terminating at its other end in a guide element which is adapted to engage a said wall corner, said elongated guide member being secured to said elongated guide support in a manner to enable the guide element to engage a said wall defining the other side of a wall corner and which intersects with the linoleum end to position the slot opposite a said wall corner with the linoleum end to be severed extending past the slot and between the bottom portion of the elongated guide support and elongated guide member whereby a cutting-tool can be inserted into said slot and projected through a said linoleum end and drawn along said slot to sever a said linoleum end to form an linoleum edge having a preselected angle which is adapted to mate with a linoleum edge having a preselected angle formed in a linoleum end positioned adjacent the other side of a wall corner to form a symmetrical coved linoleum corner between two linoleum edges having preselected angles, said elongated guide member having a gripping member located adjacent the guide element and adapted to removably engage a said linoleum end extending beyond a said wall corner to clamp a said linoleum end against the bottom portion of the elongated guide support;

a base plate extension adapted to be fastened to the end of the base plate located adjacent the end terminating in the longitudinal deflected edge, said base plate extension being adapted to engage and urge a said linoleum end against a wall to form a tight gripping surface between the elongated guide support, the base plate and the base plate extension and said linoleum end;

fastening means adapted to removably join the longitudinal reversed edge of the elongated guide support with the longitudinal deflected edge of the base plate to define the dimension of said slot; and fastening means adapted for removably affixing the elongated guide member to the bottom portion of said elongated guide support, said elongated guide member fastening means being adapted to permit relative movement of the elongated guide member relative to the elongated guide support to position the guide element relative to a said wall corner and to permit movement of the elongated guide support and base plate assembly relative to a said corner to position said cutting-tool receiving slot relative to a said wall corner.

2. The template of claim 1 wherein said elongated guide member is formed of a resilient elongated member having a bias to urge said gripping member toward the bottom of said elongated guide support.

3. The template of claim 1 wherein said cutting-tool slot is at approximately 45° as measured from the plane of the linoleum end which extends beyond a said wall corner.

4. The template of claim 1 wherein said elongated guide member fastening means further includes a spring means positioned between the end of the elongated guide member and the bottom portion of said elongated guide support to enable the elongated guide member to be pivoted about a pivot point to lift the guide element and gripping member away from the elongated guide support and to permit said spring means to urge said gripping member into intimate clamping engagement with a said linoleum end to hold the same securely in position during cutting thereof with a said cutting-tool.

5. The template of claim 4 further comprising a screw and nut assembly for fastening said base plate extension to said base plate.

6. The template of claim 5 wherein the length of said base plate extension is approximately equal in length to that of the elongated guide support.

* * * * *